US005686876A

United States Patent [19]

Yamamoto et al.

[11] Patent Number: 5,686,876

[45] Date of Patent: Nov. 11, 1997

[54] SUPERCONDUCTING MAGNET APPARATUS

[75] Inventors: Kazutaka Yamamoto; Tamaki Masegi, both of Kawasaki; Yutaka Yamada, Tokyo; Shunji Nomura, Yokohama; Toru Kuriyama, Yokohama; Takashi Yazawa, Yokohama, all of Japan

[73] Assignee: Kabushiki Kaisha Toshiba, Kawasaki, Japan

[21] Appl. No.: 345,764

[22] Filed: Nov. 22, 1994

[30] Foreign Application Priority Data

Nov. 22, 1993 [JP] Japan ..... 5-291988

[51] Int. Cl.[6] ..... H01F 1/00

[52] U.S. Cl. ..... 335/216; 335/299; 174/15.4

[58] Field of Search ..... 335/216, 299, 335/300, 301; 174/15.4

[56] References Cited

U.S. PATENT DOCUMENTS 4,692,560 9/1987 Hotta et al. ..... 335/300

FOREIGN PATENT DOCUMENTS 5-61762 9/1993 Japan .

OTHER PUBLICATIONS

Cryocooler Cooled Superconducting Magnet–4 T Class (Nb, Ti)3Sn Superconducting Magnet System with Room Temperature Bore of 38 mm– pp. 37–50 vol. 28 No. 9 (1993) Junji Sakuraba, et al.

*Primary Examiner*—Lincoln Donovan

*Attorney, Agent, or Firm*—Oblon, Spivak, McClelland, Maier & Neustadt, P.C.

[57] ABSTRACT

The superconducting magnet apparatus includes a cryostat, a superconducting coil provided in the cryostat, and a current lead having a portion made of an oxide superconductor, for supplying a current to the superconducting coil. The portion of the current lead which is made of the oxide superconductor has a high-temperature end and a low-temperature end, and the current lead is arranged such that the direction of a current flow in at least the high-temperature end and the direction of a leakage magnetic flux applied from the superconducting coil to the high-temperature end are made substantially in parallel to each other.

17 Claims, 4 Drawing Sheets

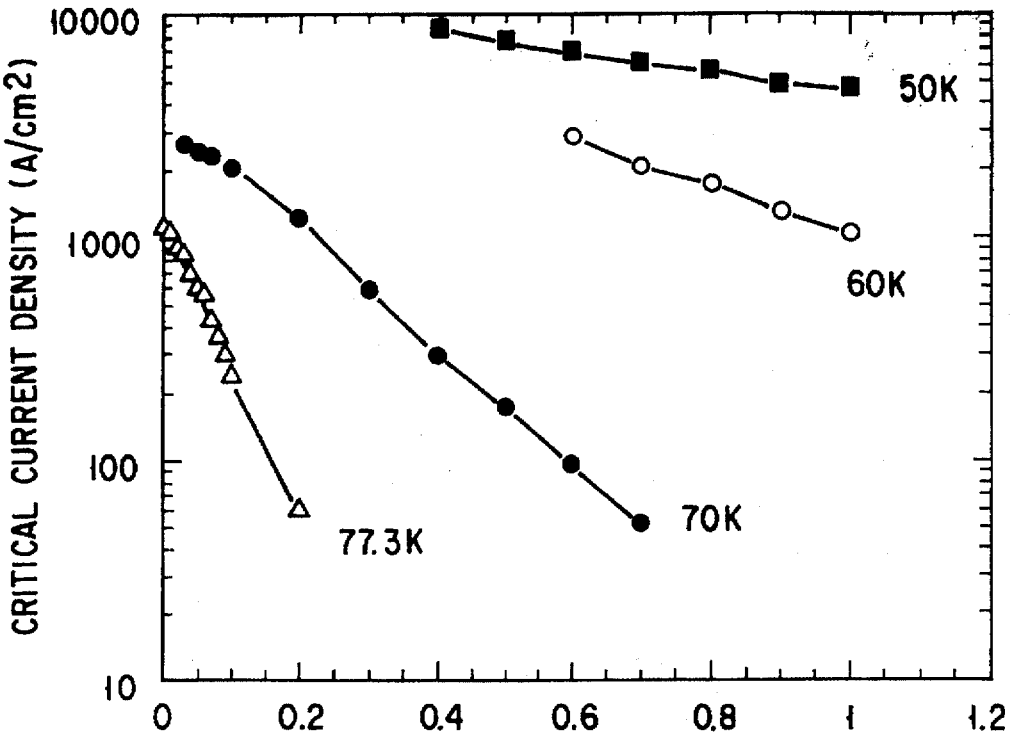
FIG. 5A MAGNETIC FIELD (T)
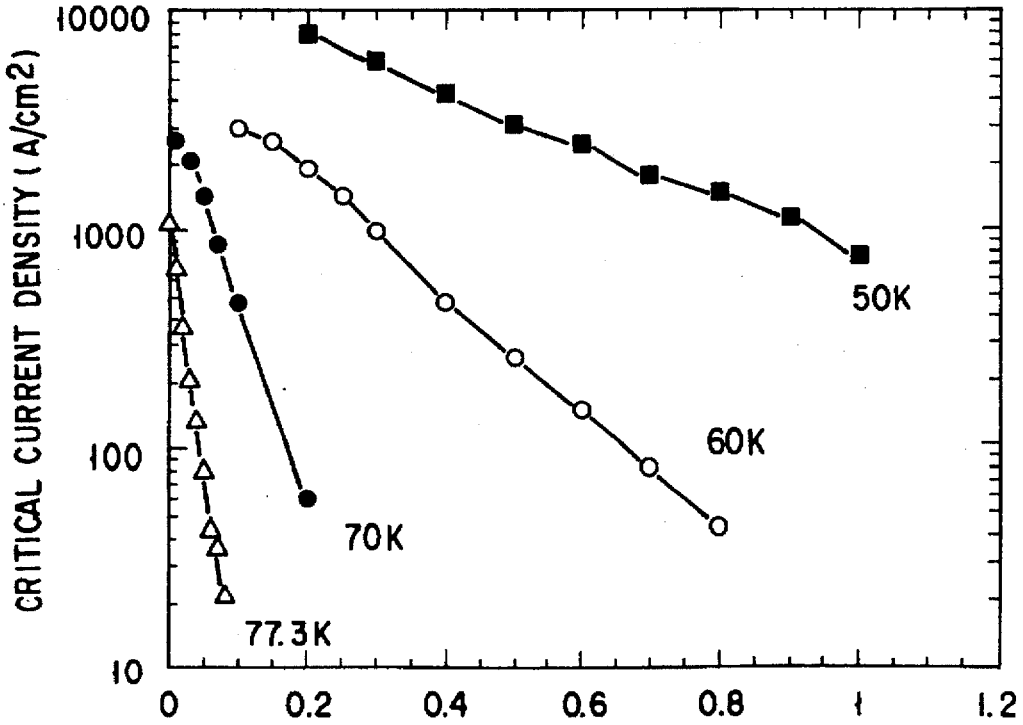
FIG. 5B MAGNETIC FIELD (T)

SUPERCONDUCTING MAGNET APPARATUS

BACKGROUND OF THE INVENTION

1. Field of the Invention

The present invention relates to a superconducting magnet apparatus, in particular, of the type where a part of the current lead for supplying a current to a superconducting coil from outside, is formed of an oxide-based superconducting material.

2. Description of the Related Art

An oxide superconductor has a critical temperature very much higher than that of metal superconductors. Lately, an oxide superconductor having a critical temperature of more than 150 K has been reported, and such an oxide superconductor is expected to be applied to various fields.

As an actual example of the oxide superconductor, a current lead (power lead) used in a superconducting magnet apparatus is considered. Generally, a superconducting magnet apparatus has a cryostat in which a superconducting coil made of a metal superconductor and a cryogen such as liquid helium are contained. In the superconducting magnet apparatus, the superconducting coil contained in the cryostat is electrically connected to a power circuit and the like which are located outside the cryostat via a current lead.

A current lead of the above-described usage requires, for example, the following characteristics. That is, no substantial joule heat is generated, or no external heat is propagated into a cryostat by conduction, or the like. In order to achieve such characteristics, there has been an attempt that the amount of heat entering into an extremely low-temperature portion can be reduced to about one-third to about one-eighth of that of a conventional copper-made current lead by forming a part of the current lead of an oxide superconductor and cooling the part made of the oxide superconductor to a critical temperature or less with, for example, liquid nitrogen.

The critical current density Jc of the oxide superconductor is greatly dependent on the temperature, the strength of magnetic field applied, the anisotropy of crystal grains, and the like. In particular, when a part of the current lead in the superconducting magnet apparatus is made of an oxide superconductor, the oxide superconductor is exposed to a leakage magnetic flux from the superconducting coil. Therefore, the critical current density cannot be set at a large value due to the leakage magnetic flux, which is not a very good condition for an oxide superconductor.

In the superconducting magnet apparatus in which a part of the current lead is made of an oxide superconductor as described above, there has been an attempt that the applied magnetic field is shielded by placing a magnetic shield made of a ferromagnetic material or a superconducting material around the oxide superconductor. However, the use of a magnetic shield is not always a very highly effective technique in terms of thermal and structural aspects.

That is, in the superconducting magnet apparatus in which a part of the current lead is made of an oxide superconductor, the influence of the leakage magnetic flux from the superconductor coil cannot be effectively removed.

SUMMARY OF THE INVENTION

The object of the present invention is to provide a superconducting magnet apparatus which is capable of effectively removing the influence of a magnetic field on an oxide superconducting lead which constitutes a part of a current lead.

A superconducting magnet apparatus according to the present invention includes a cryostat; a superconducting coil provided in the cryostat; and a current lead having a portion made of an oxide superconductor, for supplying a current to the superconducting coil, and the portion of the current lead which is made of the oxide superconductor has a high-temperature end and a low-temperature end, and the current lead is arranged such that a direction of a current flow in at least the high-temperature end and a direction of a leakage magnetic flux applied from the superconducting coil to the high-temperature end are made substantially in parallel to each other. The preferred manner is as follows.

(1) The oxide superconductor contains one selected from the group consisting of $Bi_2Sr_2CaCu_2O_{8+X}$, $(Bi,Pb)_2Sr_2Ca_2Cu_3O_{19+X}$ and $YBa_2Cu_3O_{7-X}$ (where, x is equal to or more than 0 and less than 1).

(2) The current lead is arranged to be substantially in parallel with a central axis of the superconducting coil to each other, and the high-temperature end is arranged to be substantially the same level as a central point of the superconducting coil.

(3) The superconducting magnet apparatus further comprises a magnetic shield, arranged to surround the oxide superconductor, for reducing a leakage magnetic flux from the superconducting coil.

(4) The current lead is situated on the central axis of the superconducting coil, or is arranged at a predetermined angle with respect to the superconducting coil.

(5) The superconducting magnet apparatus further comprises a refrigerator having a cooling stage for cooling the superconducting coil, at least its part of the refrigerator being incorporated in the cryostat. The cooling stage of the refrigerator is used both for cooling the superconducting coil and a portion made of the oxide superconductor.

(6) The cryostat includes a refrigerator having a first cooling stage for cooling the high-temperature end of the portion made of the oxide superconductor and a second cooling stage for cooling both the superconducting coil and the low-temperature end of the portion of the current lead, which is made of the oxide superconductor.

(7) In the manner of (6), the refrigerator includes a Gifford-McMahon type refrigerator.

(8) In the manner of (6), the current lead is located at a position further away from the superconducting coil, than a distance between the superconducting coil and the refrigerator.

Further, a superconducting magnet apparatus according to the present invention is characterized by a cryostat; a superconducting coil provided in the cryostat; a current lead having a portion made of an oxide superconductor, for supplying a current to the superconducting coil; and a refrigerator having a cooling stage for cooling the superconducting coil, at least part of the refrigerator being incorporated in the cryostat, and the current lead is arranged such that a direction of a current flow in the portion made of the oxide superconductor of the current lead and a direction of a leakage magnetic flux applied from the superconducting coil to the portion made of the oxide superconductor are made substantially in parallel to each other. The preferred manners are as follows.

(1) The portion of the current lead which is made of the oxide superconductor has a high-temperature end and a low-temperature end, and the current lead is arranged such that a direction of a current flow in at least the high-temperature end and a direction of a leakage magnetic flux applied from the superconducting coil to the high-temperature end are made substantially in parallel to each other.

(2) The cooling stage of the refrigerator is used both for cooling the superconducting coil and the portion made of the oxide superconductor.

(3) In the manner of (2), the refrigerator has a first cooling stage for cooling the high-temperature end of the portion made of the oxide superconductor and a second cooling stage for cooling both the superconducting coil and the low-temperature end of the portion made of the oxide superconductor.

(4) The current lead is placed further away from the superconducting coil than a distance between the superconducting coil and the refrigerator.

(5) The current lead is placed outside of the superconductive coil.

FIG. 1 shows the magnetic dependency of a critical current density Jc with respect to the temperature of an oxide superconductor. As can be seen in FIG. 1, as the temperature of the oxide superconductor increases, the critical current density Jc significantly decreases. Therefore, the high-temperature end portion of the oxide superconductor is strongly influenced by the magnetic field, whereas the low-temperature side is not very much influenced if exposed to a strong magnetic field. The strength of the leakage magnetic flux from the superconducting coil decreases in accordance with a distance r from the center of the superconducting coil as can be seen in FIG. 2. Consequently, in a general case, it suffices if the high-temperature end of the oxide superconductor is situated away from the center of the superconducting coil.

Many of the oxide superconductors exhibit anisotropy due to the orientation (alignment) of crystal grain. When an oxide superconductor exhibits an anisotropy, individual crystal grains of the material are distributed all over the material, with the crystal grain orientation shown in FIG. 3. Such a tendency is found in many of the oxide superconductors which are prepared by a method of growing crystals, such as a melting method. In the oxide superconductor which exhibits an anisotropy due to the orientation of the crystal grains as described above, the critical current density Jc significantly decreases in the case where a magnetic field Bb is applied vertically with respect to the current-flow direction (the growth direction of crystal grains) indicated by I in FIG. 3, as compared to the case where a magnetic field Ba is applied in parallel with the direction.

For example, the magnetic dependency at 50 K of a $Bi_2Sr_2CaCu_2O_x$ superconducting material prepared by the laser floating zone melting method is shown in FIG. 4. As can be seen in this figure, the critical current density Jc decreases remarkably in the case where the magnetic field Bb is applied vertically to the current-flow direction as compared to the case where this magnetic field Ba is applied in parallel to the direction. FIGS. 5A and 5B are graphs showing further detailed data than the data shown in FIG. 4, and each figure illustrates a relationship between the intensity of a magnetic field and a critical current density, along with various temperatures of 50 K, 60 K, 70 K and 77.3 K. FIG. 5A shows the case where the magnetic field is applied in parallel with the current direction, whereas FIG. 5B shows the case where the magnetic field is applied vertically to the current direction.

As is clear from the above data, the influence of the leakage magnetic flux cannot be effectively removed by simply setting the high-temperature end side of the oxide superconductor away from the center of the superconducting coil. When the high-temperature end side of the oxide superconductor is arranged such that the direction of the current flowing through, at least, the high-temperature end side of the oxide superconductor and the direction of the leakage magnetic flux applied from the superconducting coil to the high-temperature end side are made substantially in parallel with each other, the influence of the leakage magnetic flux can be effectively eliminated. This technique can be applied also in the case where a magnetic shield is provided around the oxide superconductor.

As described, according to the present invention, the influence of a magnetic filed on an oxide superconducting lead which constitutes a part of the current lead can be effectively removed.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 5A and 5B are graphs each showing further detailed data as compared to FIG. 4;

DETAILED DESCRIPTION OF THE PREFERRED EMBODIMENTS

An embodiment of the present invention will now be described with reference to drawings.

Figure 1:
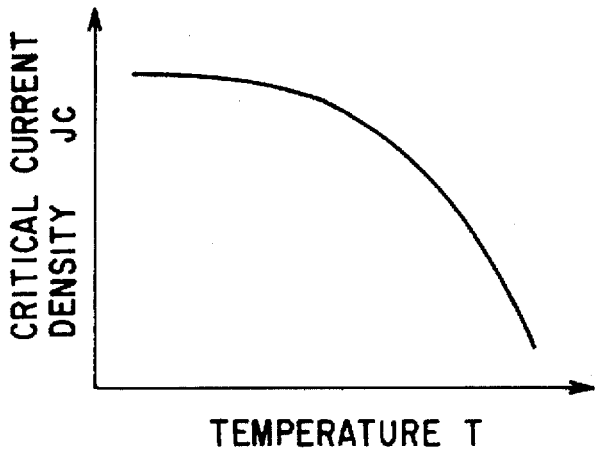
FIG. 1 is a graph showing the magnetic dependency of a critical current density with respect to the temperature of an oxide superconductor.
Figure 2:
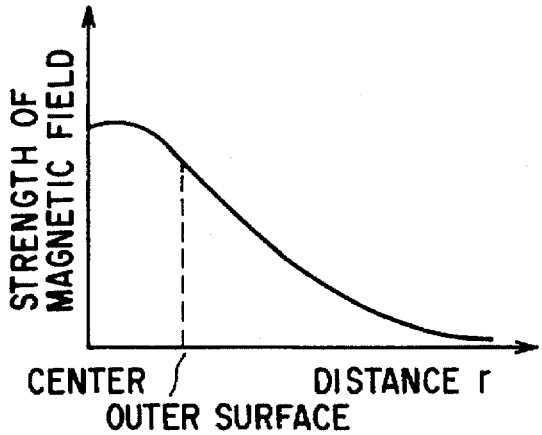
FIG. 2 is a graph showing the distribution of the strength of the leakage magnetic flux in a superconducting coil.
Figure 3:
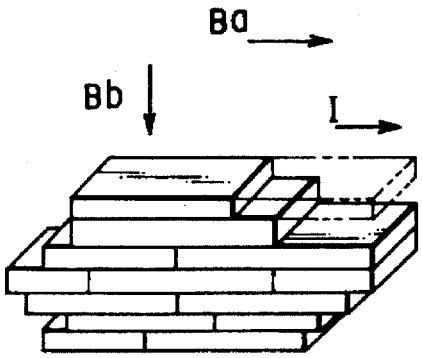
FIG. 3 is a diagram showing a crystal grain orientation structure of an oxide superconductor formed by a melting method.
Figure 4:
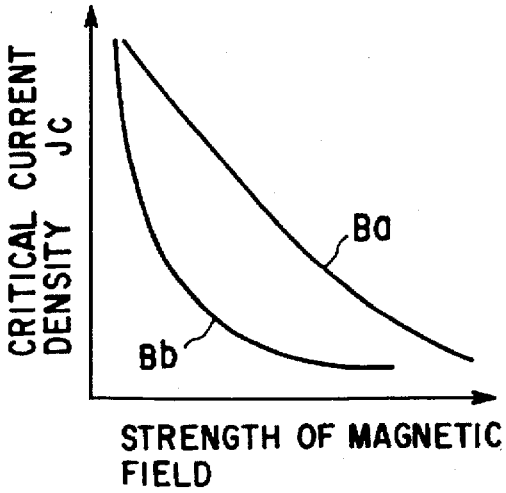
FIG. 4 is a graph showing a relationship between the magnetic filed applying direction of an oxide superconductor having the same structure as shown in FIG. 3 and the critical current density.
Figure 6:
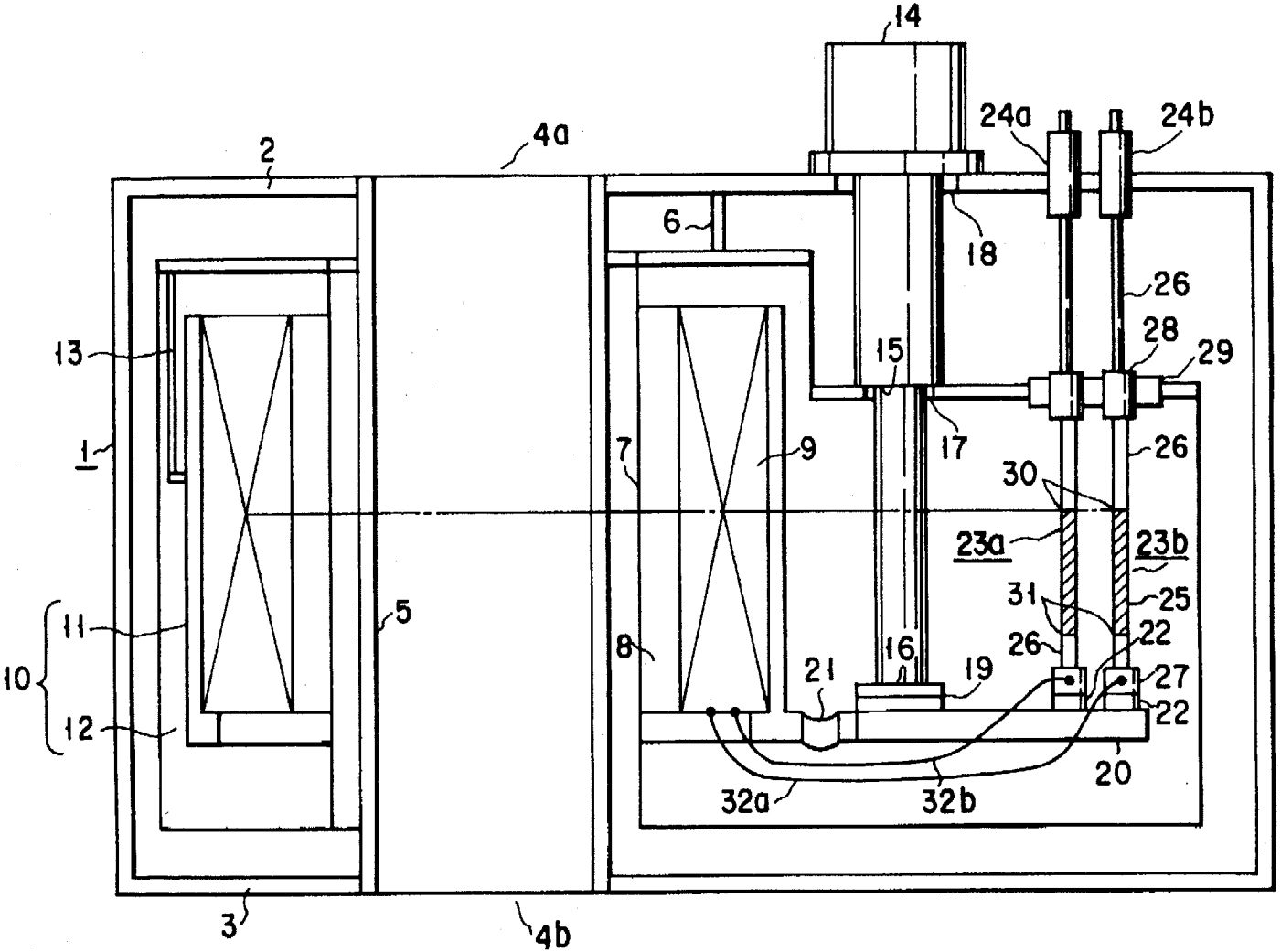
FIG. 6 is a perspective view showing the structure of a superconducting magnet apparatus according to an embodiment of the present invention.
Figure 7:
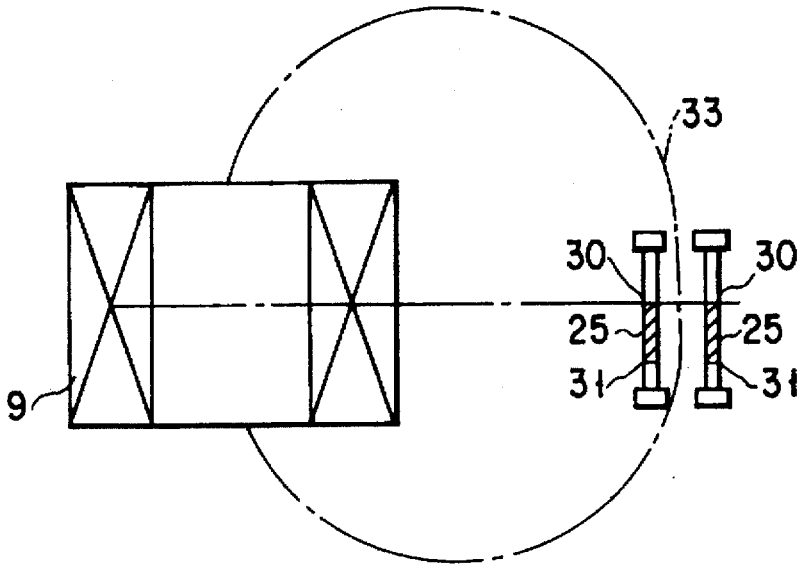
FIG. 7 is a diagram showing the relationship between the direction in which the oxide superconducting lead extends and the direction of the coil to the lead, of the embodiment shown in FIG. 6.

FIG. 6 is a schematic diagram showing the structure of a superconducting magnet apparatus (superconducting magnet apparatus of the type in which it is directly cooled by a refrigerator) according to an embodiment of the present invention.

The superconductor magnet apparatus has a vacuum chamber 1 which is evacuated so as to create a vacuum inside.

The vacuum chamber 1 is made of a non-magnetic material such as stainless steel. In specific, the vacuum chamber 1 has an upper wall 2 and a lower wall 3, and holes 4*a* and 4*b* are provided respectively in the upper and lower walls so as to oppose to each other. Both end portions of a cylinder 5 are connected to the inner surfaces of the upper wall 2 and the lower wall 3 in an air-tight manner such with the holes 4*a* and 4*b* communicate with each other. Therefore, the inside of the cylinder 5 is maintained at atmospheric pressure, whereas the outside is maintained at vacuum.

In the vacuum chamber 1, a thermal shield 7 is situated for every wall which is a part of the vacuum chamber 1 with a predetermined distance from each wall. The thermal shield 7 is provided in the vacuum chamber 1 in the state in which the shield is hung from studs 6 5 (for example, a plurality of studs made of fiber reinforced plastic or stainless steel) made of a heat insulating material, which extends from the upper wall 2 of the vacuum chamber 1. The thermal shield 7 is made by joining copper or aluminum plates or plates each having a composite structure having these metal plates, to form a bore 8 which rings the cylinder 5.

In the bore 8 surrounded by the thermal shield 7, a superconducting coil 9 is provided being not in contact with the thermal shield 7 and concentric with the cylinder 5, and the superconducting coil 9 is thermally connected to a heat conductive material 10.

The following are descriptions of specific structures of the superconducting coil 9 and the heat conductive material 10.

The superconducting coil 9 is made of a metal (such as NbTi alloy) superconducting wire, which is covered by an electrical insulating material, or a compound-based (such as $Nb_3Sn$) superconducting wire, which is covered by an electrical insulating material. Specifically, the superconductor coil 9 is formed in the following manner. A superconducting wire is wound around the circumference of a bobbin a predetermined number of times, and the wound wire is hardened by impregnating a resin having a relatively high heat conductivity, such as an epoxy resin. After that, the bobbin is removed from the wound wire, and the whole wound wire is formed into a cylindrical shape having a certain accuracy.

The heat conductive material 10 consists of a cylindrical section 11 and a loop section 12. The cylindrical section 11 is made of a high heat conductive metal such as copper or aluminum, having an inner diameter which is a predetermined amount greater than the outer diameter of the superconducting coil 9, and the cylindrical section 11 is made into a cylindrical shape having a length in an axial-direction substantially the same as that of the superconducting coil 9. The loop section 12 is formed in one body with the cylindrical section so as to project into an inner side of the inner surface of one end side of the cylindrical section 11. Further, each the cylindrical section 11 and the loop section 12 has a notch in the axial direction or divided in the axial direction so as to shut down the eddy current passage running in the circumferential direction.

While the superconducting coil 9 is inserted in the heat conductive material 10 having the above-described structure, the coil 9 is adhered directly to the cylinder 11 and the loop section 12 with an impregnated resin layer of, for example, epoxy resin. The integral member of the superconducting coil 9 and the heat conductive material 10 is suspended, with the loop section 12 of the heat conductive material 10 on the lower side, in the bore 8 by a plurality of studs 13 made of a heat insulating material, which couples the upper wall of the thermal shield 7 and the heat conductive material 10 with each other.

The heat conductive material 10 and the upper wall of the thermal shield 7 are connected to an extremely low temperature refrigerator, more specifically, in this embodiment, a cooling stage of a Gifford-McMahon refrigerator (to be abbreviated "GM refrigerator" hereinafter) 14.

The GM refrigerator 14 employs a copper mesh or the like as a cold regenerating material of a primary coil regenerator, and a magnetic cold regenerating material as a secondary cold regenerating material, which is exemplified by $Er_3Ni$, and the refrigerator 14 includes a first cooling stage 15 which is cooled to about 70 K and a second cooling stage 16 which is cooled down to a level of 4 K. The axial line of the GM refrigerator 14 is arranged in parallel with the axial line of the superconducting coil 9, and the first cooling stage 15 is situated between the thermal shield 7 on the outer side of the superconducting coil 9 with regard to the radial direction thereof and a wall which constitutes the vacuum chamber 1, whereas the second cooling stage 16 is situated in the space surrounded by the thermal shield 7 on the outer side of the superconducting coil 9 with regard to the radial direction thereof. The GM refrigerator 14 is set in the thermal shield 7 and the vacuum chamber 1 by means of a hole 17 made in the upper wall of the thermal shield 7 and an insertion hole 18 made in the upper wall of the vacuum chamber 1.

The first cooling stage 15 of the GM refrigerator 14 arranged as described above is thermally connected to the upper wall of the thermal shield 7, and the second cooling stage 16 is thermally and mechanically connected to a flexible thermal conductor 20 via a material 19 which is made of soft metal or the like having a high heat conductivity such as Indium (In). The flexible thermal conductor 20 is thermally connected to the aforementioned heat conductive material 10 via a plastic flexible thermal conductor 21.

One end of each of a current lead 23*a* and a current lead 23*b* is held above the upper surface of the flexible thermal conductor 20 at a position opposite to the superconducting coil side with respect to the second cooling stage 16, via a high heat conductive insulating member 22. The other end of each of the current leads 23*a* and 23*b* extends upwards in parallel with the axial line of the superconducting coil 9, and is connected to the central conductor of each of bushing 24*a* and bushing 24*b* set in the upper wall of the vacuum chamber 1.

The current leads 23*a* and 23*b* serve to connect rod-shaped oxide superconducting leads 25 (indicated by shaded portions) to rod-shaped copper leads 26 respectively in series. The oxide superconducting leads 25 are made of a $Bi_2Sr_2CaCu_2O_{8+K}$ superconductor (critical temperature of 70 K or higher) formed by, for example, a laser floating zone melting method. Each oxide superconducting lead 25 may be formed of $(Bi, Pb)_2Sr_2Ca_2Cu_3O_{10+X}$ or $YBa_2Cu_3O_{7-X}$; however, the effect of the present invention will be very much prominent when a highly oriented (anisotropic) material is used as the superconducting lead 25. One end of each oxide superconducting lead 25 is connected to the copper lead 26 by, for example, soldering.

The lower end of the copper lead 26 is connected to the terminal 27 and an intermediate portion of the copper lead 26 is connected to the upper wall portion of the thermal shield 7 with a terminal 28 by soldering. The terminals 27 and 28 are made of copper blocks. The terminal 27 is fixed to the flexible thermal conductor 20 via the insulating material 22, and the terminal 28 is fixed thermally and mechanically to the upper wall of the thermal shield 7 via a thermal anchor 29 having a high heat conductivity, such as aluminum nitride.

Each oxide superconducting lead 25 is arranged such that its upper end portion (i.e. a high-temperature end 30) is in parallel with the direction of a leaking magnetic field applied from the superconducting coil 9 to the high-temperature end 30. In other words, each oxide superconducting lead 25 is arranged such that the direction of the current flowing through the high-temperature end 30 is substantially in parallel with the direction of the leaking magnetic field applied from the superconducting coil 9 to the high-temperature end 30. In this embodiment, the oxide superconducting lead 25 is arranged such that the high-temperature end 30 is at the same level as the central position of the superconducting coil 9 with respect to the axial direction, and the superconducting coil 9 and the oxide superconducting lead 25 are in parallel with each other.

Both ends of the wire of the superconducting coil 9 are electrically connected to the respective terminals 27 of the current leads 23*a* and 23*b* via a superconducting wire 32*a* and a superconducting wire 32*b* which are made of the same wiring material as that of the superconducting coil 9. It is naturally preferable that the superconducting wires 32*a* and 32*b* should be thermally connected to the flexible thermal conductor 20 in an electrically insulating state.

In FIG. 6, the vacuum exhaustion system for exhausting the vacuum chamber 1, the measuring system for measuring the temperature and the like, and the control system for controlling the GM refrigerator 14 are not shown.

With the above-described structure, when the GM refrigerator 14 is started, the temperature at each of the first cooling stage 15 and the second cooling stage 16 of the GM refrigerator 14 decreases. As a result, the sensible heat of a so-called intermediate portion, such as the thermal shield 7 and the current leads 23*a* and 23*b*, is propagated to the first cooling stage 15 by conduction. The sensible heat of the lower end side (in the figure) of each of the superconductor coil 9, the heat conductive material 10, the flexible thermal conductor 20, the flexible thermal conductor 21, the current lead 23*a* and the current lead 23*b* is propagated to the second cooling stage 16 by conduction.

Consequently, the sensible heat is absorbed by the GM refrigerator 14, and each of the above members is gradually cooled. Eventually, the thermal shield 7 and the high-temperature end of the oxide superconducting leads 25 are cooled to about 70 K or less, and the superconducting coil 9, the heat conductive material 10, the flexible thermal conductor 20, the heat conductive member 21, the low-temperature end 31 of the oxide superconducting lead 25, which is close to the terminal 27, are cooled to a level of 4 K.

At this temperature, the wire which forms the superconducting coil 9 is transformed into a superconducting state. Further, the oxide superconducting lead 25 which constitutes a part of each of the current leads 23*a* and 23*b* is transformed into a superconducting state. With this superconducting state, a current can be allowed to flow through the superconducting coil 9.

When a current is allowed to flow through the current lead 23*a* and the current lead 23*b*, a joule heat is generated in the copper lead 26. Further, an external heat is led in via a copper lead 26 by conduction. On the other hand, with the oxide superconductor lead 25, no joule heat is generated. The joule head generated in the copper lead 26 and the conducted led-in heat are absorbed by the first cooling stage 15 via the terminal 28, the thermal anchor 29 and the upper wall of the thermal shield 7. Consequently, the heat which tends to come into the vacuum chamber via the current lead 23*a* and the current lead 23*b* is absorbed in the region where the temperature is at a level of 70 K.

As described above, in the superconducting magnet apparatus according to the present embodiment, the high-temperature end 30 of the oxide superconducting lead 25 is arranged such that the direction of a current flowing through the high-temperature end 30 and the direction of the leak magnetic field 33 applied from the superconducting coil 9 to the high-temperature end 30 are made substantially in parallel with each other. Consequently, a so-called strong current lead arrangement can be realized with respect to the leak magnetic field from the superconducting coil 9. This argument can be applied also in the case where a magnetic field is provided around the oxide superconducting lead 25. Further, a magnetic shield may be provided for the above arrangement in order to increase the critical current density.

The present invention is not limited to the above embodiment.

Figure 8:
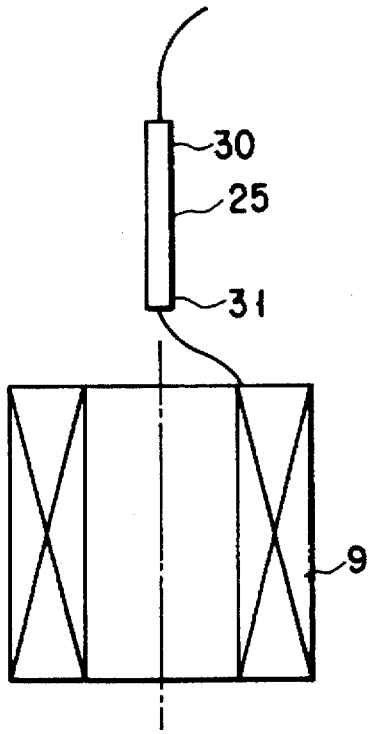
FIG. 8 is a diagram showing the first variation of the arrangement of the oxide superconducting lead with respect to superconducting coil.

In the above embodiment, the oxide superconducting lead which constitutes a part of the current lead is situated on the outer side of the superconducting coil with respect to the radial direction. However, it is also possible that the oxide superconducting lead 25 is placed on the axial line of the superconducting coil 9, and the low-temperature end 31 is located on the superconducting coil side, whereas the high-temperature end 30 is located on the opposite side away from the superconducting coil, as shown in FIG. 8. In this case also, the direction of current flowing in the high-temperature end and the direction of the leak magnetic field 33 applied from the superconducting coil 9 to the high-temperature end 30 can be made substantially in parallel to each other. Therefore, an advantage similar to that of the above embodiment can be achieved.

Figure 9:
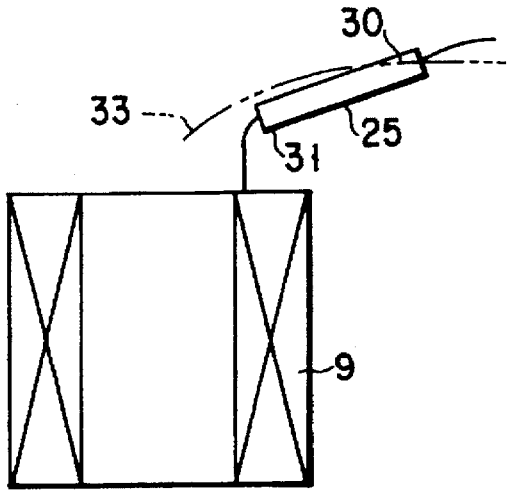
FIG. 9 is a diagram showing the second variation of the arrangement of the oxide superconducting lead with respect to the superconducting coil.

Further, as shown in FIG. 9, it is also possible to tilt the oxide superconducting lead 25 with respect to the axial line of the superconducting coil 9 such that the low-temperature end 31 is situated on the superconducting coil side, and the high-temperature end 30 is situated on the opposite side to the superconducting coil side. In this case also, the direction of current flowing in the high-temperature end and the direction of the leak magnetic field 33 applied from the superconducting coil 9 to the high-temperature end 30 can be made substantially in parallel to each other. Therefore, an advantage similar to that of the above embodiment can be achieved.

The embodiment shown in FIG. 6 is an example where the present invention is applied to the refrigerator-direct-cooling type superconducting magnet apparatus. However, the present invention can be also applied to a superconducting magnetic apparatus of the type in which the low-temperature ends of a superconducting coil and an oxide superconducting lead are cooled with liquid helium, and the high-temperature end of an oxide superconducting lead is cooled with liquid nitrogen.

The superconducting magnetic apparatus according to the invention as described above can be incorporated in such as MRI apparatus.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A superconducting magnet apparatus comprising:

a cryostat;

a superconducting coil provided in said cryostat; and a current lead having a portion made of an oxide superconductor, for supplying a current to said superconducting coil, wherein said portion of said current lead which is made of said oxide superconductor has a high-temperature end and a low-temperature end, and said current lead is arranged such that a direction of a current flow in at least said high-temperature end and a direction of a leakage magnetic flux applied from said superconducting coil to said high-temperature end are made substantially in parallel to each other.

2. A superconducting magnet apparatus according to claim 1, wherein said oxide superconductor contains one selected from the group consisting of $Bi_2Sr_2CaCu_2O_{8+X}$, $(Bi,Pb)_2Sr_2Ca_2Cu_3O_{10+X}$ and $YBa_2Cu_3O_{7-X}$ (where, X is equal to or more than 0 and less than 1).

3. A superconducting magnet apparatus according to claim 1, wherein said current lead is arranged to be substantially in parallel with a central axis of said superconducting coil to each other, and said high-temperature end is arranged to be substantially the same level as a central point of said superconducting coil.

4. A superconducting magnet apparatus according to claim 1, further comprising a magnetic shield, arranged to surround said oxide superconductor, for reducing a leakage magnetic flux from said superconducting coil.

5. A superconducting magnet apparatus according to claim 1, wherein said current lead is situated on the central axis of said superconducting coil.

6. A superconducting magnet apparatus according to claim 1, wherein said current lead is arranged at a predetermined angle with respect to said superconducting coil.

7. A superconducting magnet apparatus according to claim 1, further comprising a refrigerator having a cooling stage for cooling said superconducting coil, at least its part of said refrigerator being incorporated in said cryostat.

8. A superconducting magnet apparatus according to claim 7, wherein said cooling stage of said refrigerator is used both as cooling said superconducting coil and a portion made of said oxide superconductor.

9. A superconducting magnet apparatus according to claim 1, wherein said cryostat includes a refrigerator having a first cooling stage for cooling said high-temperature end of said portion made of said oxide superconductor and a second cooling stage for cooling both said superconducting coil and said low-temperature end of said portion of said current lead, which is made of said oxide superconductor.

10. A superconducting magnet apparatus according to claim 9, wherein said refrigerator includes a Gifford-McMahon type refrigerator.

11. A superconducting magnet apparatus according to claim 9, wherein said current lead is located at a position further away from said superconducting coil, than a distance between said superconducting coil and said refrigerator.

12. A superconducting magnet apparatus comprising:

a cryostat;

a superconducting coil provided in said cryostat;

a current lead having a portion made of an oxide superconductor, for supplying a current to said superconducting coil; and a refrigerator having a cooling stage for cooling said superconducting coil, at least part of said refrigerator being incorporated in said cryostat, wherein said current lead is arranged such that a direction of a current flow in said portion made of said oxide superconductor of said current lead and a direction of a leakage magnetic flux applied from said superconducting coil to said portion made of said oxide superconductor are made substantially in parallel to each other.

13. A superconducting magnet apparatus according to claim 12, wherein said portion of said current lead which is made of said oxide superconductor has a high-temperature end and a low-temperature end, and said current lead is arranged such that a direction of a current flow in at least said high-temperature end and a direction of a leakage magnetic flux applied from said superconducting coil to said high-temperature end are made substantially in parallel to each other.

14. A superconducting magnet apparatus according to claim 12, wherein said cooling stage of said refrigerator is used both as cooling said superconducting coil and said portion made of said oxide superconductor.

15. A superconducting magnet apparatus according to claim 13, wherein said refrigerator has a first cooling stage for cooling said high-temperature end of said portion made of said oxide superconductor and a second cooling stage for cooling both said superconducting coil and said low-temperature end of said portion made of said oxide superconductor.

16. A superconducting magnet apparatus according to claim 12, wherein said current lead is placed away from said superconducting coil than a distance between said superconducting coil and said refrigerator.

17. A superconducting magnet apparatus according to claim 12, wherein said current lead placed outside of said superconductive coil.

* * * * *